US006623406B2

(12) United States Patent
Wu

(10) Patent No.: US 6,623,406 B2
(45) Date of Patent: Sep. 23, 2003

(54) LEG-EXERCISING DEVICE

(76) Inventor: Dong-Her Wu, P.O. Box 453, Taichung (TW)

( * ) Notice: Subject to any disclaimer, the term of this patent is extended or adjusted under 35 U.S.C. 154(b) by 49 days.

(21) Appl. No.: 09/985,215

(22) Filed: Nov. 2, 2001

(65) Prior Publication Data

US 2003/0087730 A1 May 8, 2003

(51) Int. Cl.[7] ..... A63B 71/00
(52) U.S. Cl. ..... 482/51; 482/57; 482/60
(58) Field of Search ..... 482/51, 52, 53, 482/57–65

(56) References Cited

U.S. PATENT DOCUMENTS 5,295,927 A * 3/1994 Easley et al. ..... 482/52
5,679,100 A * 10/1997 Charnitski ..... 482/51
6,280,363 B1 * 8/2001 Harrell ..... 482/57
6,500,100 B1 * 12/2002 Harrell ..... 482/57

* cited by examiner

*Primary Examiner*—Nicholas D. Lucchesi
*Assistant Examiner*—Tam Nguyen
(74) *Attorney, Agent, or Firm*—Harrison & Egbert

(57) ABSTRACT

A leg-exercising device comprises a base, two slide rail seats, two transmission members, and two pedals. The slide rail seats are mounted on the base and are provided therein with a receiving space for disposing the transmission member which is formed of two sprocket wheels and a drive chain running on the two sprocket wheels. The pedals are slidably mounted on the transmission members such that the pedals move up and down along the drive chains of the transmission members.

4 Claims, 10 Drawing Sheets

LEG-EXERCISING DEVICE

BACKGROUND OF THE INVENTION

1. Field of the Invention

The present invention relates generally to an exercise machine, and more particularly to a leg-exercising device.

2. Description of Related Art

There are a variety of exercise machines available in the market place for consumers to choose from. These conventional exercise machines are generally cumbersome and can not be therefore moved around or stored easily. In addition, the conventional exercise machines take up a large floor space.

BRIEF SUMMARY OF THE INVENTION

The primary objective of the present invention is to provide a leg-exercising device which can be used in a place where the floor space is limited.

It is another objective of the present invention to provide a leg-exercising device which can be used in conjunction with an ordinary chair for building the leg muscles.

In keeping with the principle of the present invention, the foregoing objectives of the present invention are attained by the leg-exercising device comprising a base, two slide rail seats, two transmission members, and two pedals. The slide rail seats are mounted on the base for housing the transmission members. The two pedals are slidably mounted on the transmission members such that the pedals move up and down along the drive chains of the transmission members.

BRIEF DESCIPTION OF THE SEVERAL VIEWS OF THE DRAWINGS

DETAILED DESCRIPTION OF THE INVENTION

Figure 1:
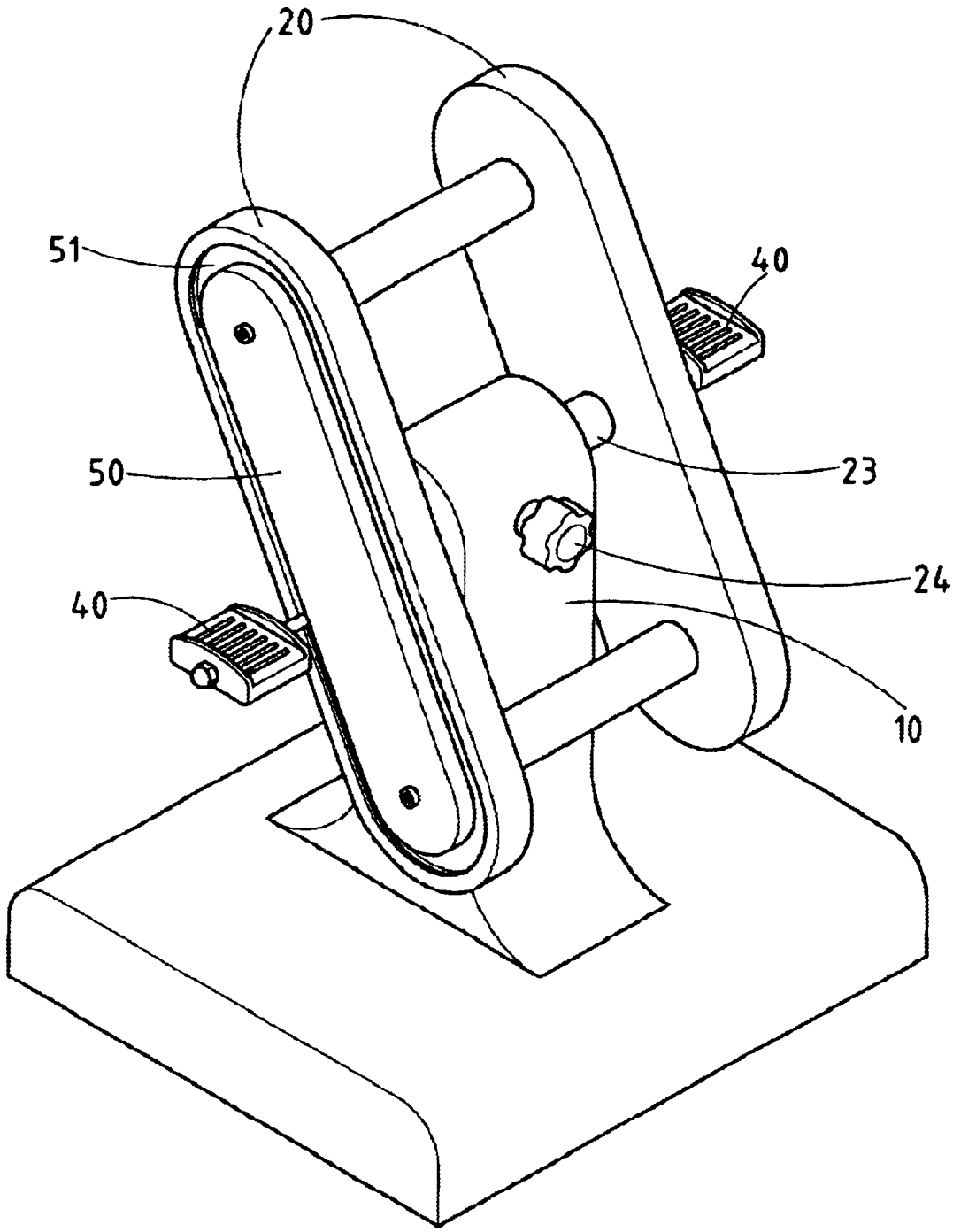
FIG. 1 shows a perspective view of the present invention.

As shown in FIGS. 1–8, a leg-exercising device of the present invention comprises a base 10, two slide rail seats 20, two transmission members 30, two pedals 40, and two covering plates 50.

The base 10 is rested on a surface to support the leg-exercising device on the surface.

The slide rail seats 20 are mounted on the base 10 and are provided therein with a receiving space 21.

The transmission members 30 are mounted in the receiving spaces 21 of the two slide rail seats 20 and are formed of two sprocket wheels 31 and 32, a drive chain 33 fitted with the sprocket wheels 31 and 32, and two support rods 34 and 35 for mounting the two sprocket wheels 31 and 32.

The two pedals 40 are slidably mounted on the drive chains 33 of the transmission members 30.

The two covering plates 50 are respectively fitted with the slide rail seats 20 to shield the transmission members 30 such that the fringe of the covering plates 50 and the inner wall of the receiving spaces 21 of the slide rail seats 20 form therebetween a slide slot 51.

Figure 2:
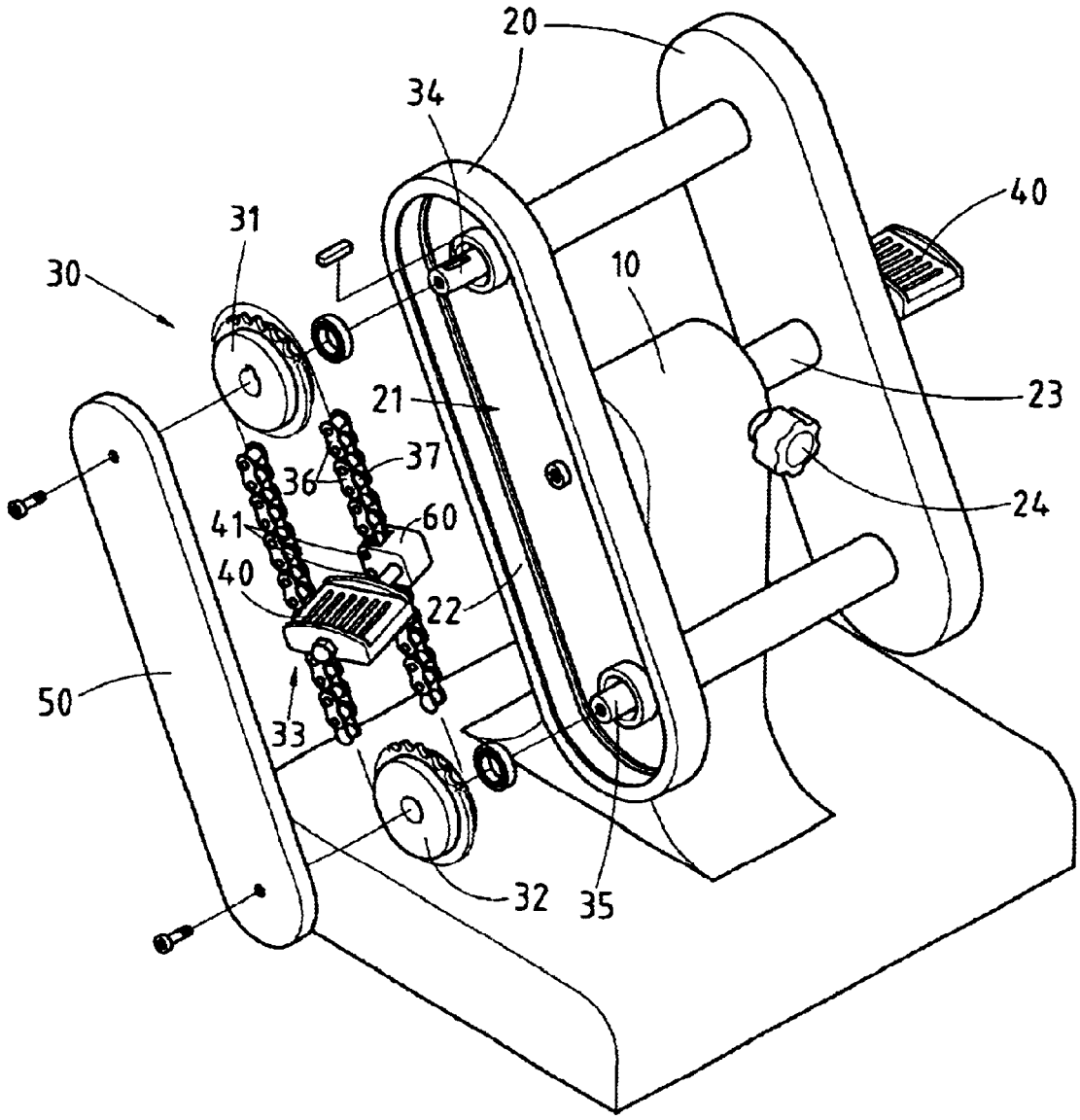
FIG. 2 shows an exploded view of the present invention.

As shown in FIGS. 1 and 2, the two slide rail seats 20 are fastened with a tilting rod 23 enabling the two slide rail seats 20 to be tilted. Upon having been tilted, the slide rail seats 20 are located by a locating piece 24.

Figure 3:
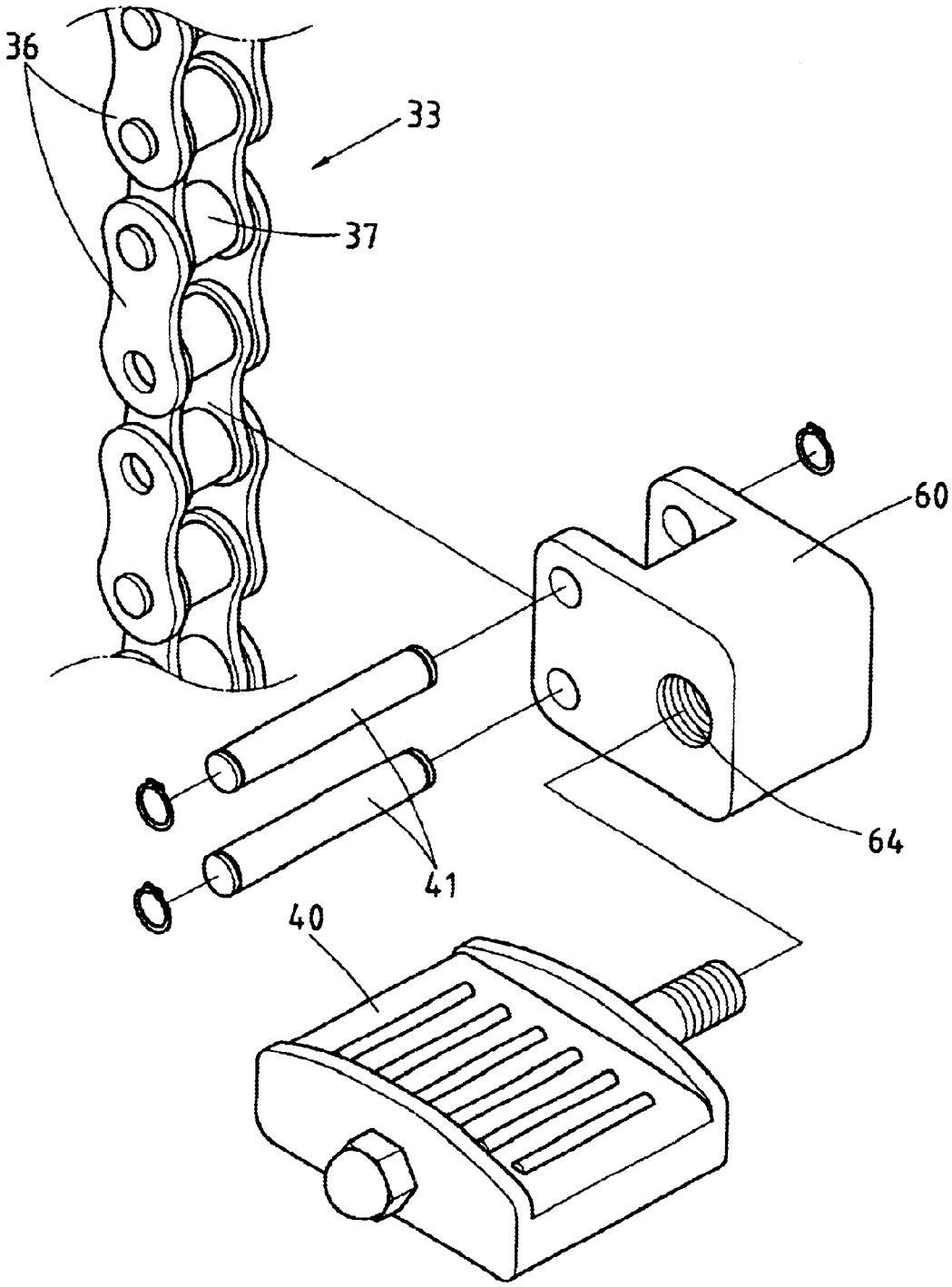
FIG. 3 shows a partial exploded view of the present invention.
Figure 4:
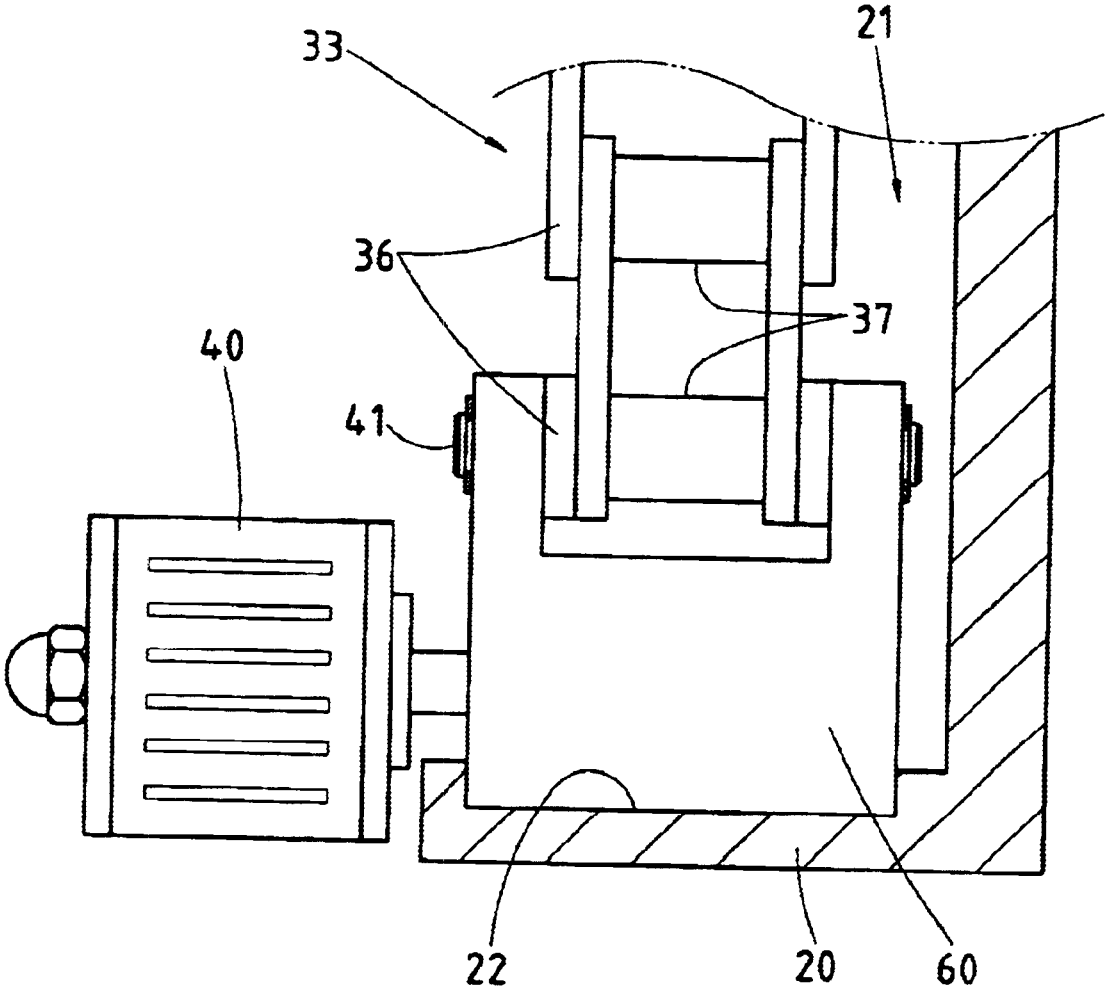
FIG. 4 shows a partial sectional view of the present invention.
Figure 5:
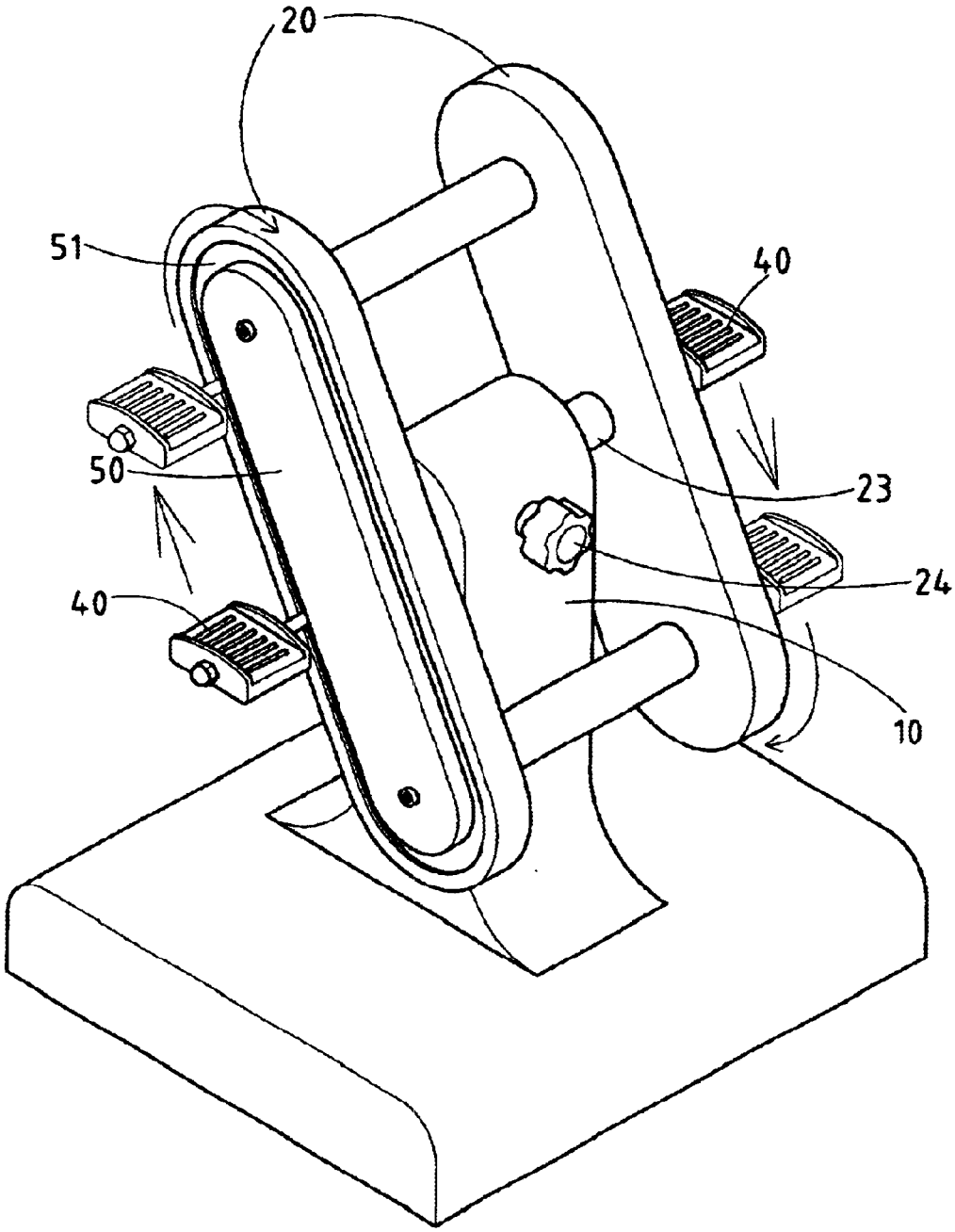
FIG. 5 shows a schematic view of present invention at work.
Figure 6:
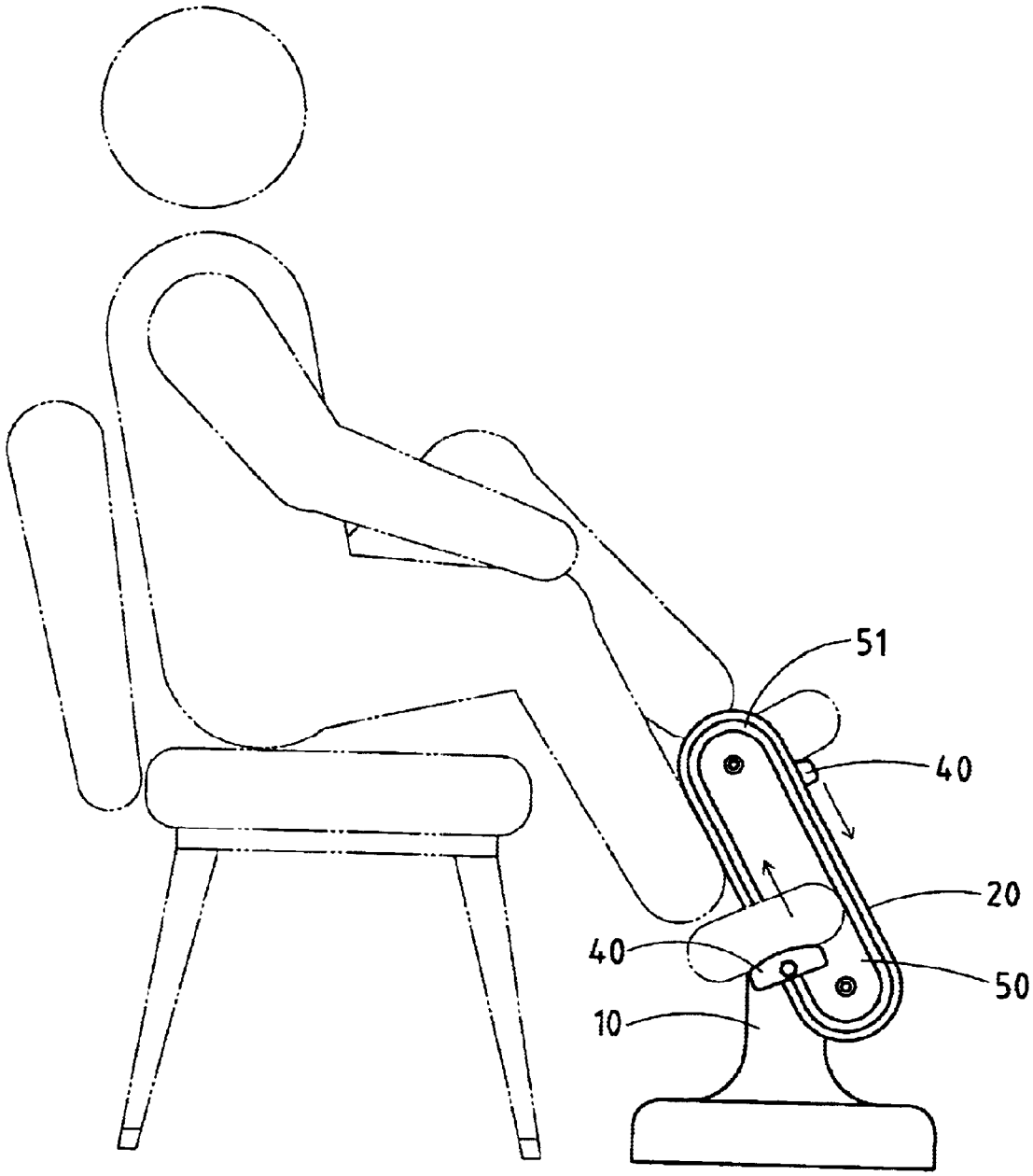
FIG. 6 shows a schematic view of the present invention in use.
Figure 7:
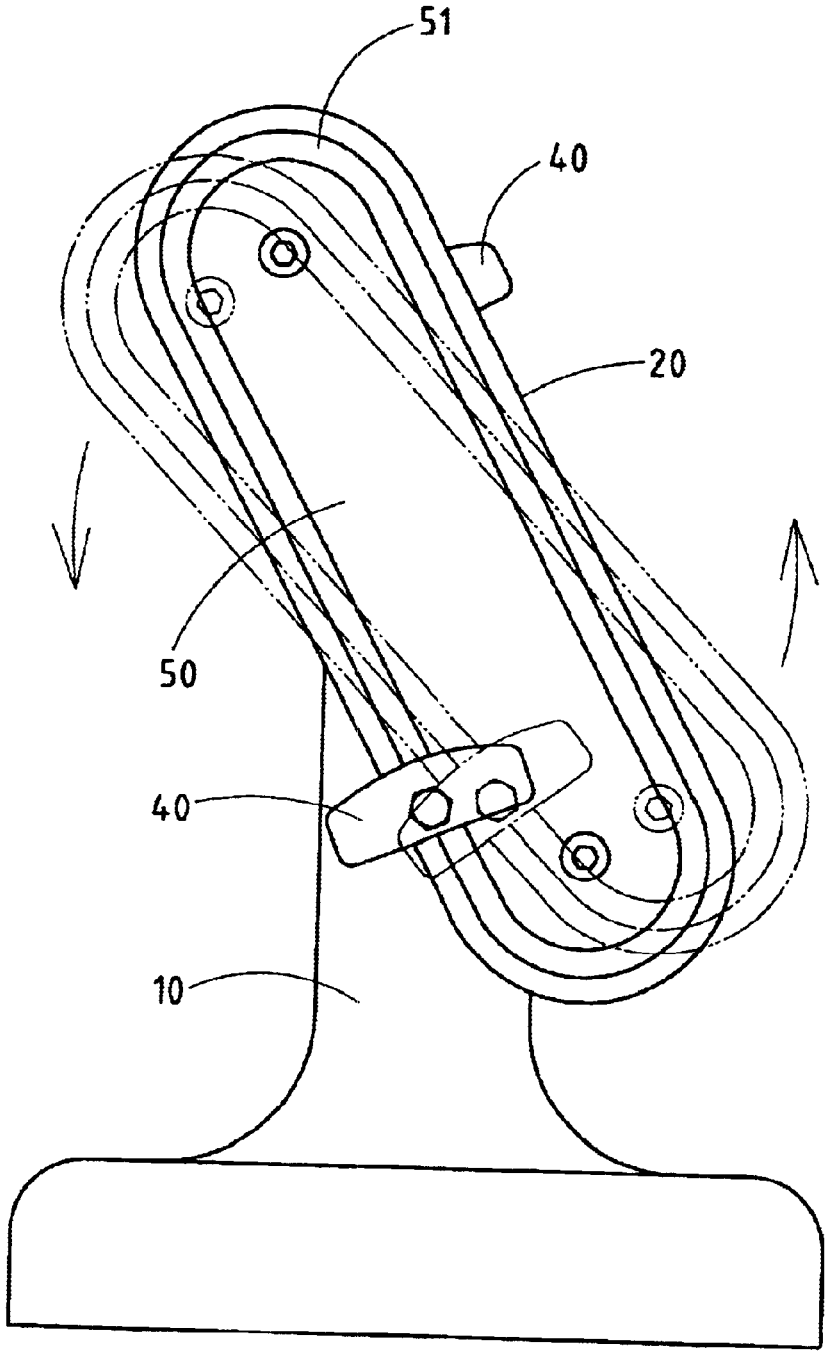
FIG. 7 shows a side schematic view of the present invention at work.

As shown in FIGS. 3 and 4, the drive chain 33 is formed of a plurality of links 36 and link rods 37. The pedals 40 are fastened to a fastening hole 64 of a pedal fastening block 60. The link rods 37 are fastened with the fastening rods 41 for fastening the pedal fastening block 60 which serves to stabilize the pedals 40 in motion.

Figure 9:
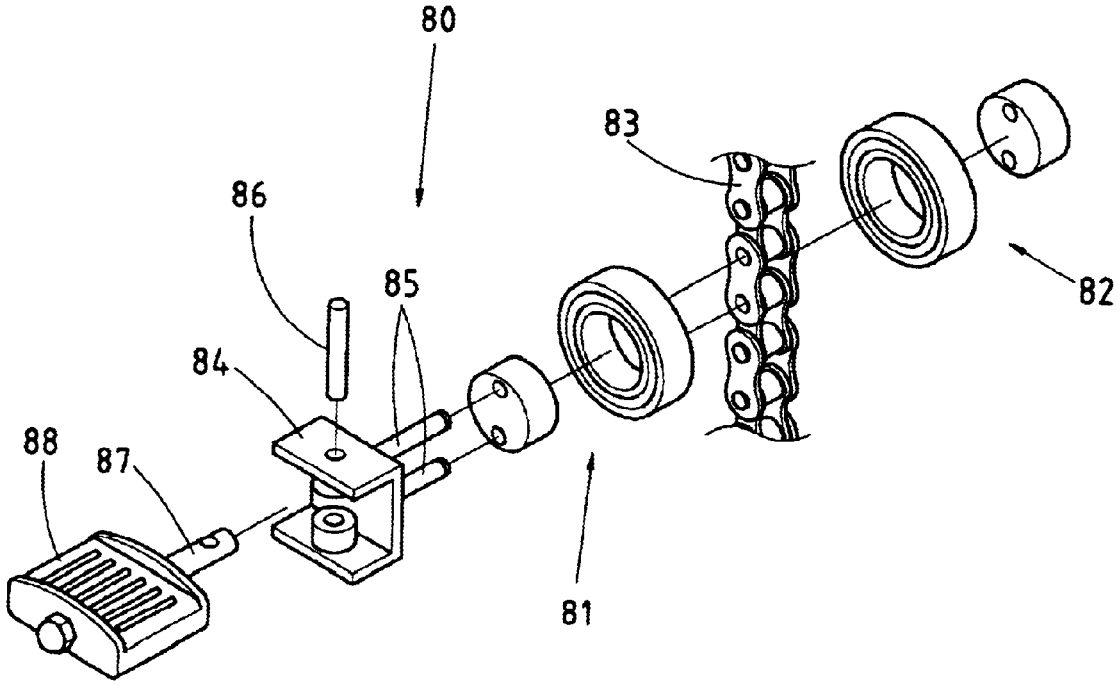
FIG. 9 shows a partial exploded view of another preferred embodiment of the present invention.

FIG. 9 shows an alternative embodiment of the pedal assembly 80 for use in the present invention. The pedal assembly 80 includes bearing assemblies 81 and 82 respectively located on opposite sides of the links 83. A pedal fastening block 84 is provided with two fastening pillars 85. The two fastening pillars 85 are received within the bearing assemblies 81 and 82. A pin 86 extends through the pedal fastening block 84 so as to engage the fastening rod 87 of pedal 88.

The drive chains 33 may be replaced by belts which run-on the two wheels 31 and 32.

Figure 8:
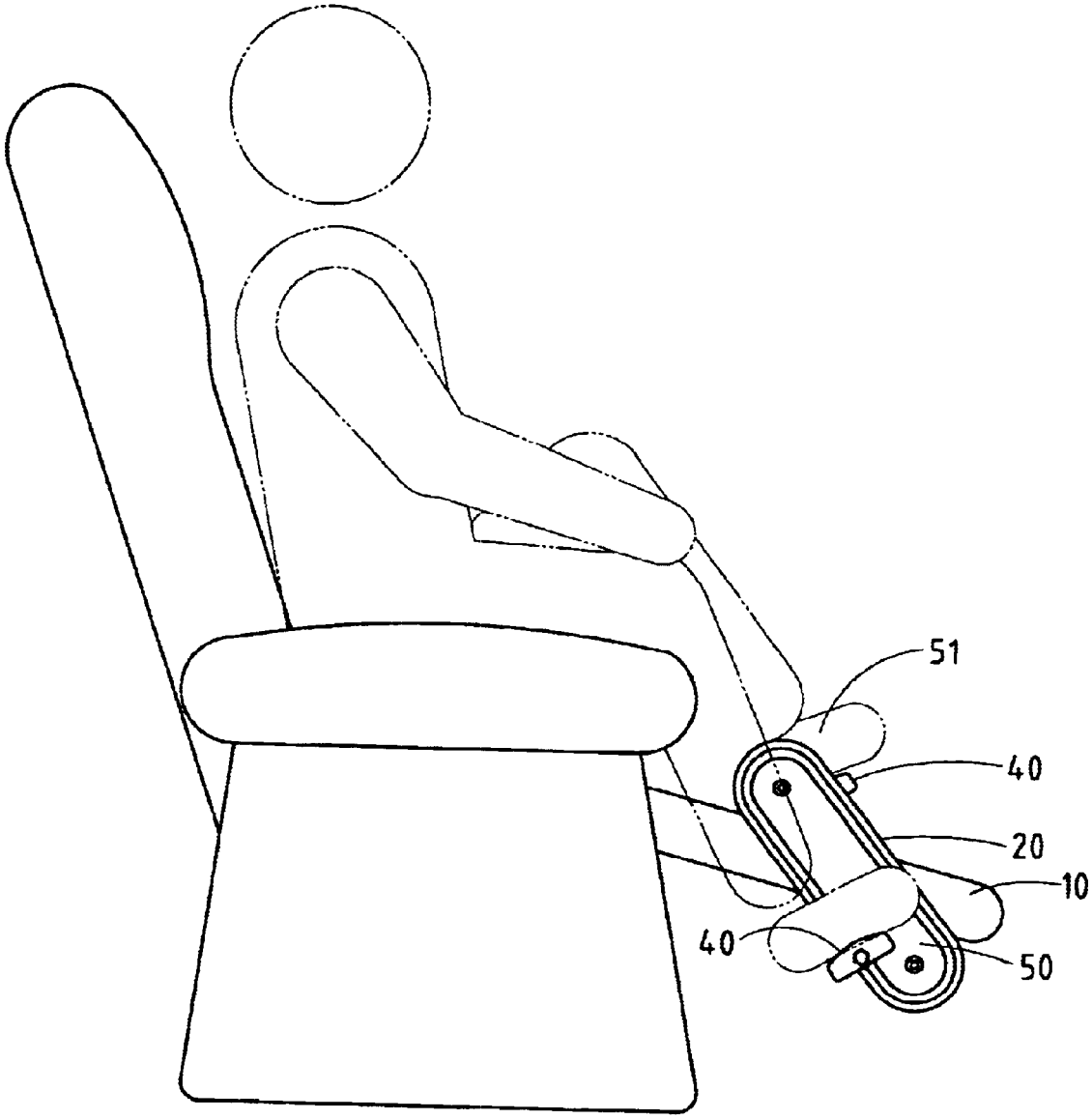
FIG. 8 shows a schematic view of the present invention in use in conjunction with a massaging chair.
Figure 10:
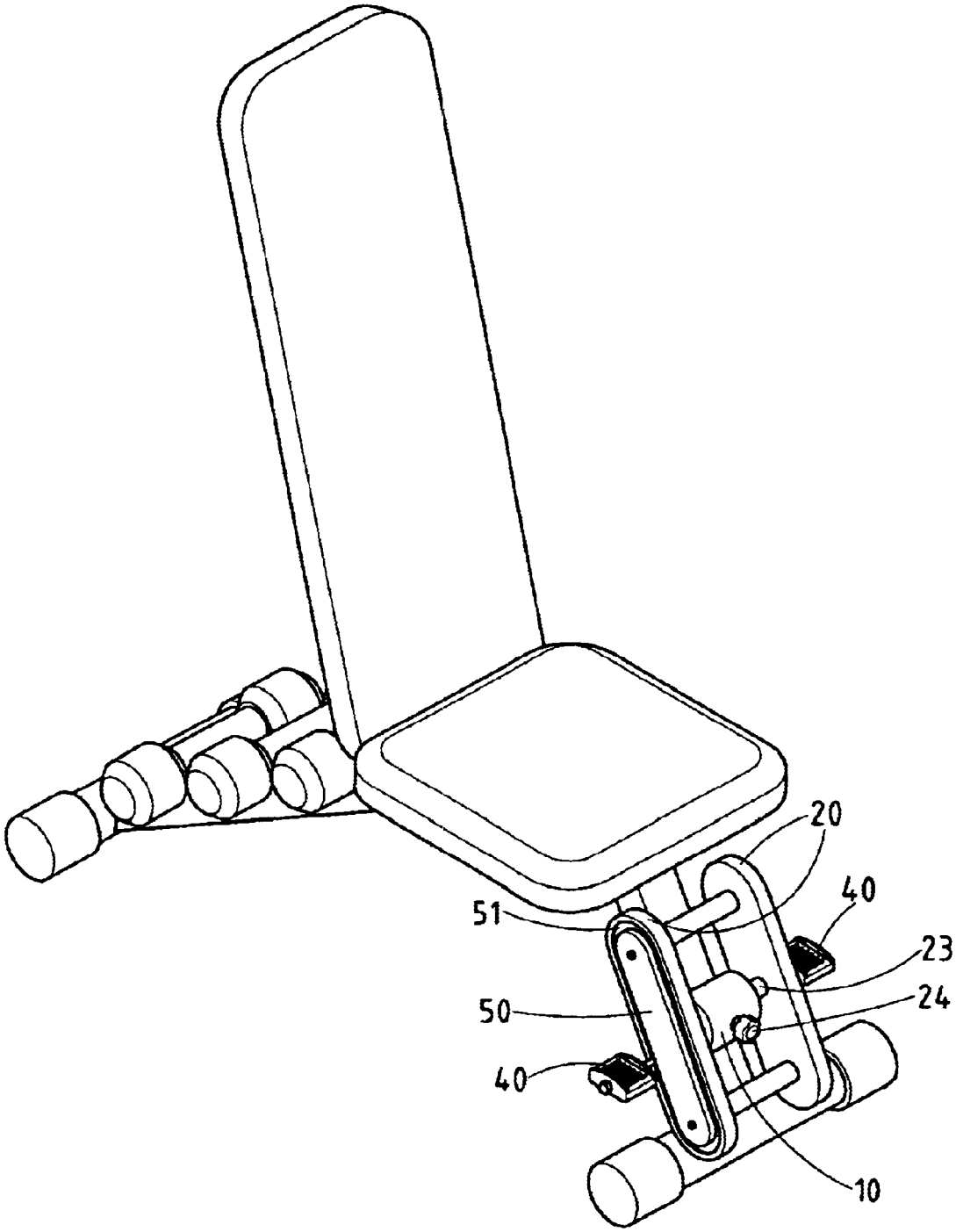
FIG. 10 shows a schematic perspective view of the present invention in use in conjunction with a chair.

The present invention can be used in conjunction with a massage chair, as shown in FIG. 8, or an exercise chair, as shown in FIG. 10.

I claim:

1. A leg-exercising device comprising:

a base;

a pair of slide rail seats respectively mounted on opposite sides of said base, each of said pair of slide rail sea having a receiving space therein;

a pair of transmission members respectively mounted in said receiving space of said pair of slide rail seats, each of said pair of transmission members having a first wheel and a second wheel with a drive chain extending thereover and therebetween, the first wheel of one of said pair of transmission members and the first wheel of the other of said pair of transmission members being mounted on a first support rod, the second wheel of said one of said pair of transmission member and the second wheel of the other of said pair of transmission members being mounted on a second support rod;

a pair of covering plates fitted respectively onto said pair of slide rail seats such that a periphery of the covering plate and an inner wall of the slide rail seat defines a generally oval slide slot;

a pair of pedal fastening blocks respectively affixed to the drive chains of each of said pair of transmission member, each of the drive chains having a plurality of links, each of said pair of pedal fastening blocks being secured to the drive chain by a pair of fastening rods engaged with the links of the drive chain; and a pair of pedal respectively fastened to said pair of pedal fastening blocks such that said pair of pedals moves along with the drive chains.

2. The device of claim 1, further comprising:

a tilting rod supported upon said base, said pair of slide rail seats being respectively mounted onto said tilting rod; and a location means received by said base and cooperative with said tilting rod, said locating means for selectively setting a position of said tilting rod so as to angularly orient said pair of slide rails seats.

3. The device of claim 1, further comprising:

a pair of bearings affixed respectively to the drive chains of said pair of transmission members, said pair of fastening rods of the pedal being received by the respective bearing of said pair of bearings.

4. The device of claim 1, said drive chain being a belt.

* * * * *